United States Patent [19]

Jarosz et al.

[11] Patent Number: 4,656,450

[45] Date of Patent: Apr. 7, 1987

[54] TRANSFORMER AND FERRITE CORE STRUCTURE THEREFOR

[75] Inventors: Andrew Jarosz; Kent Callahan, both of Belleville, Canada

[73] Assignee: Northern Telecom Limited, Montreal, Canada

[21] Appl. No.: 862,089

[22] Filed: May 12, 1986

[51] Int. Cl.[4] ..... H01F 27/26; H01F 27/30

[52] U.S. Cl. ..... 336/83; 336/92; 336/192; 336/208

[58] Field of Search ..... 336/65, 90, 83, 98, 336/192, 92, 198, 208, 221

[56] References Cited

U.S. PATENT DOCUMENTS

| | | | |
|---|---|---|---|
| 2,548,239 | 4/1951 | Ray | 336/83 X |
| 3,090,907 | 5/1963 | Maeda | 336/83 X |
| 3,227,980 | 1/1966 | Roser | 336/83 X |
| 3,271,713 | 9/1966 | Oshima | 336/83 |
| 3,284,748 | 11/1966 | Matsumoto | 336/83 X |
| 3,358,256 | 12/1967 | Naito et al. | 336/192 X |
| 3,471,815 | 10/1969 | Grant et al. | 336/83 |
| 3,507,039 | 4/1970 | Craige | 336/83 X |
| 3,859,614 | 1/1975 | Reithmaier | 336/192 X |
| 4,149,135 | 4/1979 | Roespel et al. | 336/65 |
| 4,427,961 | 1/1984 | Suzuki | 336/83 |

FOREIGN PATENT DOCUMENTS

| | | | |
|---|---|---|---|
| 1027265 | 4/1958 | Fed. Rep. of Germany | 336/192 |
| 17222 | of 1905 | United Kingdom | 336/83 |

*Primary Examiner*—Thomas J. Kozma
*Attorney, Agent, or Firm*—J. E. Moorhouse

[57] ABSTRACT

A ferrite core structure for line circuit transformers includes a ferrite spindle for receiving transformer windings, thereby avoiding the need for a separate bobbin as used in conventional line circuit transformers. The ferrite core structure includes a ferrite base for supporting the ferrite spindle and a ferrite cover which fits over the spindle so as to complete a magnetic circuit through the spindle and the base. The base, spindle and cover when assembled define a space for containing the windings.

2 Claims, 2 Drawing Figures

TRANSFORMER AND FERRITE CORE STRUCTURE THEREFOR

The invention relates to transformers and to a ferrite core structure useful for transformers.

Telephone loops which are associated with a telephone switching facility are usually terminated at the switching facility by a line circuit, one line circuit per loop. Most such line circuits include a transformer which contributes significantly to the size and cost of the line circuit. As one line circuit is required per telephone loop, and each switching facility may serve many thousands of loops, such transformers contribute significantly to the cost of the entire switching facility.

Many attempts have been made to design line circuits of lesser cost through reducing the bulk of various circuit components and by using newer devices including semiconductor components to replace the transformer. Many of these attempts fail to meet all of the typical line circuit operational requirements, or are not yet cost competitive with present widely used line circuits.

A ferrite core structure in accordance with the invention includes a ferrite spindle for receiving windings, thereby avoiding the need for a separate bobbin as typically used in line circuit transformers.

Stated in other terms, the invention provides a ferrite core structure comprising: an integral ferrite spindle and base and a ferrite cover for mounting to the base to cover the spindle. The spindle has a flange remote from the base and a step adjacent the base for carrying windings directly on the spindle between the step and the flange. The base, spindle and cover when assembled complete a magnetic circuit and define a space for containing the windings.

Stated in yet other terms, the invention provides a transformer comprising: an integral ferrite spindle and base, the spindle having a flange remote from the base and a step adjacent the base; transformer windings carried directly on the spindle between the step and flange; a ferrite base for supporting the spindle; a ferrite cover for mounting to the base over the spindle so as to complete a magnetic circuit through the spindle and the base, the base, spindle and cover when assembled defining a space for containing the windings; and a terminal plate for mounting to the base opposite the spindle, the terminal plate including a plurality of conductive terminals for electrical connection to ends of the windings.

Figure 1:
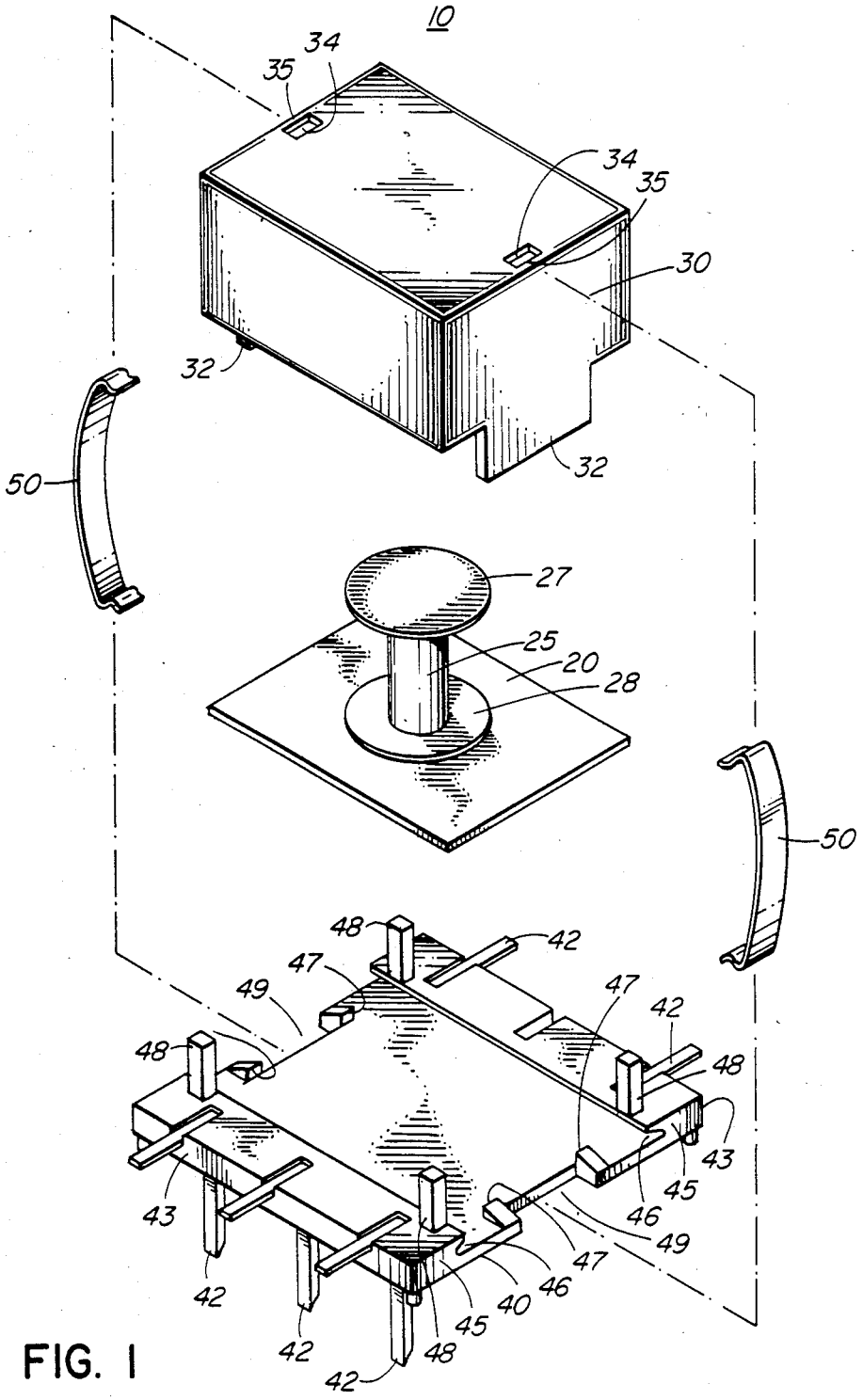
Figure 2:
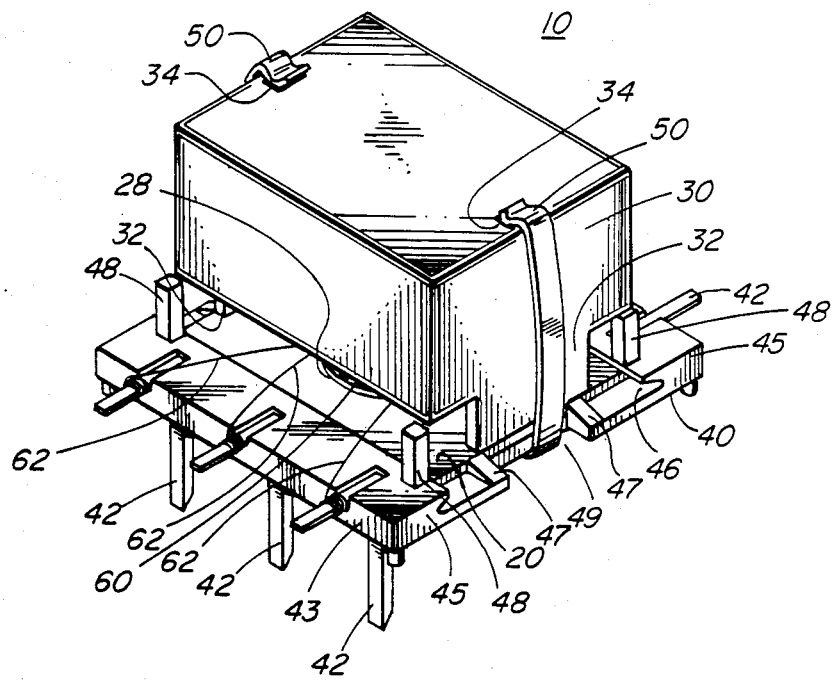

Example embodiments are described in the following with reference to the accompanying drawings in which:

FIG. 1 is an exploded perspective view of a ferrite core assembly in accordance with the invention; and FIG. 2 is a perspective view of a transformer including the ferrite core structure of FIG. 1.

A ferrite core structure 10 comprises a ferrite base in the form of a ferrite baseplate 20, a ferrite spindle in the form of a ferrite bobbin 25, and a ferrite cover in the form of a ferrite cap 30. The bobbin 25 includes a flange 27 remote from the baseplate 20 and step 28 adjacent the baseplate 20. The bobbin 25 and the baseplate 20 are integral. The cap 30 includes depending projections 32 and recesses 34 having lips 35. A plastic terminal plate 40 includes terminals in the form of L-shaped conductive posts 42 protruding laterally beyond edges 43 and through the terminal plate 40 so as to project in a direction perpendicular to the terminal plate 40. The terminal plate 40 includes elongated projections 45 having opposed lateral grooves 46 therein, and stop formations 47, as well as projections 48 and lateral recesses 49.

Film insulated magnet wire (38 AWG) is wound directly on the bobbin 25 between the flange 27 and the step 28 to make transformer or inductor windings 60. The flange 27 and the step 28 help to contain the windings 60 on the bobbin 25 during the winding process. The baseplate 20 is inserted into the grooves 46 of the terminal plate 40. The grooves 46 slidably receive the baseplate 20 as it rides over one pair of the stop formations 47, until it engages the other pair of the stop formations 47 and drops into place between the two pairs of stop formations 47. The stop formations 47 positively locate and retain the baseplate 20 in the grooves 46. The windings 60 on the bobbin 25 are terminated by electrically connecting each winding end 62 to a separate one of the posts 42. The cap 30 fits over the baseplate 20 and the bobbin 25 so as to contact the flange 27, the depending projections 32 contacting the baseplate 20 adjacent the bobbin 25 so as to complete a magnetic circuit. The windings 60 are thus contained in a space defined by the baseplate 20, the spool 25 and the cap 30. The projections 48 of the terminal plate 40 separate the winding ends 62 connected to the posts 42 from the depending projections 32 of the cap 30. The recesses 34 in the cap 30 and the lateral recesses 49 in the terminal plate 40 receive resilient retainers in the form of spring clips 50 to secure the cap 30 to the terminal plate 40. Depending portions of the conducting posts 42 are intended to be soldered to a printed circuit board, not shown.

A transformer suitable for use in a line circuit can be constructed in the manner described above so as to have all linear dimensions less than 0.5 inches. Such transformers are especially applicable to transformer assisted active impedance line feed circuits such as those described in U.S. Pat. No. 4,484,032 issued to Stanley D. Rosenbaum on Nov. 20, 1984.

What is claimed is:

1. A transformer, comprising:

an integral ferrite spindle and base, said spindle having a flange remote from said base and a step adjacent said base;

transformer windings carried directly on said spindle between said step and said flange;

a ferrite cover for mounting to said base over said spindle and said windings so as to complete a magnetic circuit through said spindle and said base; and a dielectric terminal plate for mounting to said base opposite said spindle, said terminal plate carrying a plurality of conductive terminals for electrical connection to ends of said windings, elongated projections having opposed lateral grooves therein for slidably receiving said base, and stop formations for engaging said base to positively locate and retain said base in said grooves.

2. A transformer, comprising:

an integral ferrite spindle and base, said spindle having a flange remote from said base and a step adjacent said base;

transformer windings carried directly on said spindle between said step and said flange;

a ferrite cover for mounting to said base over said spindle and said windings so as to complete a magnetic circuit through said spindle and said base, said cover including a plurality of depending projections for contacting said base adjacent said spindle; and a dielectric terminal plate for mounting to said base opposite said spindle, said terminal plate carrying a plurality of conductive terminals for electrical connection to ends of said windings, and a plurality of projections for separating said ends of said windings from said depending projections.

* * * * *